United States Patent [19]

Kane

[11] Patent Number: 4,691,492

[45] Date of Patent: Sep. 8, 1987

[54] INTERLOCKING ROOF TILE

[75] Inventor: Patrick J. Kane, Vancouver, Canada

[73] Assignee: Creative Metal Designs Ltd., Vancouver, Canada

[21] Appl. No.: 709,208

[22] Filed: Mar. 7, 1985

[51] Int. Cl.[4] ..... E04D 1/00

[52] U.S. Cl. ..... 52/519

[58] Field of Search ..... 52/519, 520, 536, 537, 52/518, 533, 534

[56] References Cited

U.S. PATENT DOCUMENTS

| | | | |
|---|---|---|---|
| 267,904 | 11/1882 | Lane et al. | 52/536 |
| 279,487 | 6/1883 | Jones | 52/519 |
| 294,256 | 2/1884 | Montross et al. | 52/519 |
| 297,530 | 4/1884 | Mott | 52/520 |
| 341,966 | 5/1886 | Thorn | 52/519 |
| 361,031 | 4/1887 | Thorn | 52/519 |
| 397,298 | 2/1889 | Lee | 52/519 |
| 403,837 | 5/1889 | Gusten et al. | 52/536 |
| 458,152 | 8/1891 | Bickelhoupt | 52/519 |
| 472,680 | 4/1892 | Montross | 52/519 |
| 562,798 | 6/1896 | Bröcker | 52/533 |
| 2,202,830 | 6/1940 | Bussey | 108/17 |
| 3,775,925 | 12/1973 | Fujita | 52/534 |

FOREIGN PATENT DOCUMENTS

| | | | |
|---|---|---|---|
| 63433 | 9/1913 | Austria | 52/519 |

*Primary Examiner*—William F. Pate, III
*Assistant Examiner*—John Malcolm White
*Attorney, Agent, or Firm*—Carver & Co.

[57] ABSTRACT

The present tile is adapted to cooperate with similar tiles to form a tiled surface, and is formed from a relatively thin sheet having a periphery disposed symmetrically about a central axis. When the tile is installed the central axis coincides with a line defining free water flow down the tile between upper and lower tile portions. The tile has first and second raised ribs extending symmetrically as mirror images of each other on each side of the central axis. Each rib has upper and lower rib portions which are interconnected so as to extend continuously between the upper and lower tile portions to increase stiffness of the tile. The stiffened tile is better able to resist weight of a person walking on the roof, and also resists a tendency for the lower portion of the tile to lift when wind blows onto the roof. The upper rib portions are smaller than, and complementary to, the lower rib portions so that the lower rib portions of an upper tile can fit over upper rib portions of a lower tile. When so fitted, the edges of the tiles are interlocked and this increases accuracy of installation of the tiles, as well as reducing a tendency of water seepage past edges of the tiles.

23 Claims, 5 Drawing Figures

FIG. 1
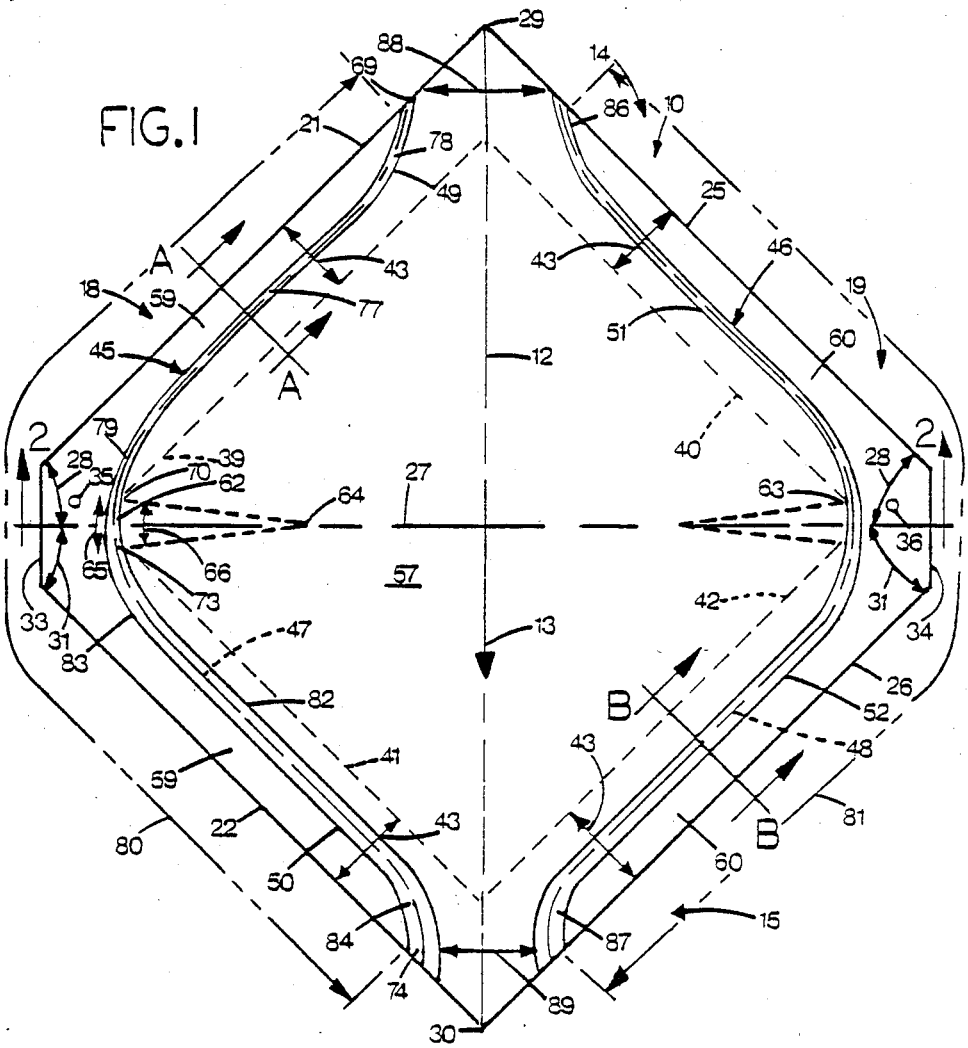
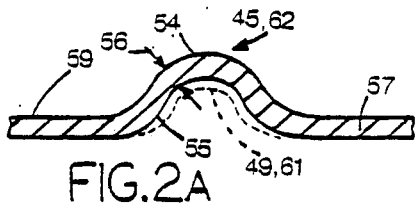
FIG. 2A
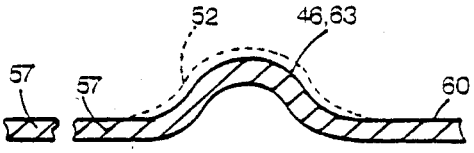
FIG. 2B
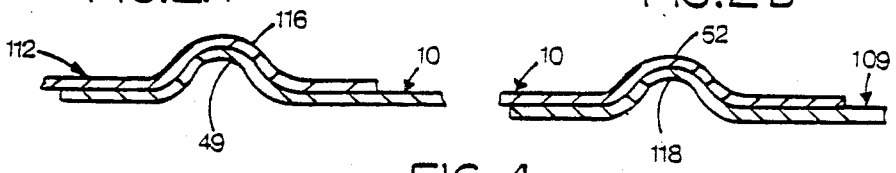
FIG. 4

INTERLOCKING ROOF TILE

BACKGROUND OF THE INVENTION

1. Field of the Invention

The invention relates to a tile particularly for installation on a sloping roof, but the tile could have applications elsewhere, for example on a vertical wall.

2. Prior Art

Conventional interlocking roof tiles or shingles have been known for many years, and are commonly found as two main types, namely relatively thick clay tiles, or sheet tiles, which are made from sheet metal or other similar thin material. The clay tiles are heavy, mechanically relatively weak and are limited in mechanical complexity due to manufacturing difficulties and material limitations. Metallic sheet tiles also have problems, for example a tendency to bend and be permanently deformed after a person has walked over the roof, due to insufficient backing support for the tile. Also, if a relatively thin material is usued, the tile might lack adequate stiffness to resist bending under strong wind forces blowing up the roof and bending the tile upwardly, thus permitting water to penetrate under the tile. While attempts have been made to stiffen relatively thin tiles using raised ribs, commonly the ribs do not extend continuously along the length of the tile between upper and lower ends, and thus there is an area of weakness between the ribs. Also, the use of stiffening ribs or corrugations in a metallic tile can increase difficulty of installation of the tile because some designs of tile do not permit much variation or tolerance to the "fit" between adjacent tiles. Commonly, with prior art ribbed metallic tiles, fitting errors during installation of a series of tiles can accumulate to such an extent that unsightly gaps can exist between adjacent tiles, which can permit entry of water into the roof. Typical metallic tiles are shown in U.S. Pat. No. 279,487 issued to Jones; U.S. Pat. No. 361,031 issued to Thorne; U.S. Pat. No. 397,298 issued to Lee, and U.S. Pat. No. 2,202,830 issued to Bussey. These four patents disclose metallic roofing tiles with corrugations to cooperate with adjacent tiles, and partially to stiffen the tile. However, some of the edge fitting structure is quite complex and would likely present difficulties when installing the tiles. Also stiffening ribs in these tiles do not extend continuously down the tile.

Some of the prior art tiles have interfitting edge portions which cooperate closely with complementary edge portions of adjacent tiles such that a relatively small gap exists between the tiles. This gap can be sufficiently small as to cause water to be drawn by capillarity through the gap, around corrugations and into the roof, giving the impression of a leaking roof.

SUMMARY OF THE INVENTION

The present invention reduces the difficulties and disadvantages of the prior art by providing a tile which is relatively simple to manufacture by pressing a thin sheet of metal, and can be installed using relatively unskilled labour due to relatively wide fitting tolerance resulting from the simplicity of the structure which cooperates with adjacent tiles. Portions of tiles which cooperate with adjacent tiles can b made to have a wide tolerance to variations in spacing between adjacent tiles, and can accommodate, to some extent, irregularities in the roof. Furthermore, the tiles of the invention have raised rib portions which provide the stiffness which extends the full length of the tile i.e. between upper and lower tile portions, which can resist the weight of a person walking on the roof, without permanent deformation. Furthermore, the stiffness of the tile is such that strong wind blowing upwards along the roof will have a negligible tendency to lift the tile, when compared with some prior art tiles. Also, spacing between cooperating portions of adjacent tiles is such as to reduce any tendency for capillarity effects to draw water horizontally, or slightly upwardly between adjacent tiles.

A tile according to the invention is adapted to cooperate with similar tiles to form a tiled surface. The tile is a relatively thin sheet having a periphery having first and second side edges intersecting at upper and lower corners and being disposed symmetrically about a central axis extending between the corners so that, when the tile is installed, the central axis conincides with a line defining free water flow down the tile between upper and lower tile portions. The side edges are mirror images of each other about the central axis. The tile is further characterised by first and second raised ribs extending symmetrically as mirror images of each other on each side of the central axis. Each rib has upper and lower rib portions which are interconnected so as to extend continuously between the upper and lower tile portions to increase stiffness of the tile. The upper and lower rib portions have rib axes which are also mirror images of each other about a lateral axis disposed normally to the central axis. The upper and lower rib portions are substantially similar in cross-section to each other and extend smoothly between the upper and lower tile portions. The ribs intersect the respective side edges generally adjacent to the upper and lower corners to provide first and second intermediate edge portions extending between the intersections of the first and second ribs with the first and second side edges respectively. A generally flat first side margin of the tile extends between the intermediate first edge portion and the first rib, and a generally flat second side margin of the tile extends between the intermediate second edge portion and the second rib. The upper rib portions are generally complementary to, the lower rib portions, so that the lower rib portions of an upper tile can fit over upper rib portions of a lower tile.

A detailed disclosure following, related to drawings, described several embodiments of the invention, which is capable of expression in structure other than that described and illustrated.

DESCRIPTION OF THE DRAWINGS

FIG. 1 is a simplified top plan of a tile according to the invention,

FIG. 2A is a simplified fragmented section, as would be seen partially on line 2—2 of FIG. 1, with another fragmented section as would be seen from line A—A of FIG. 1 superimposed thereon for comparison of size, FIG. 2B is a simplified fragmented section on line 2—2 of FIG. 1, with another similar fragmented section as would be seen from line B—B of FIG. 1 superimposed thereon to show a comparison of size, FIG. 4 is a simplified fragmented section on line 4—4 of FIG. 3, showing cooperation between adjacent edge portions of tiles.

DETAILED DISCLOSURE

FIGS. 1, 2A and 2B

Figure 3:
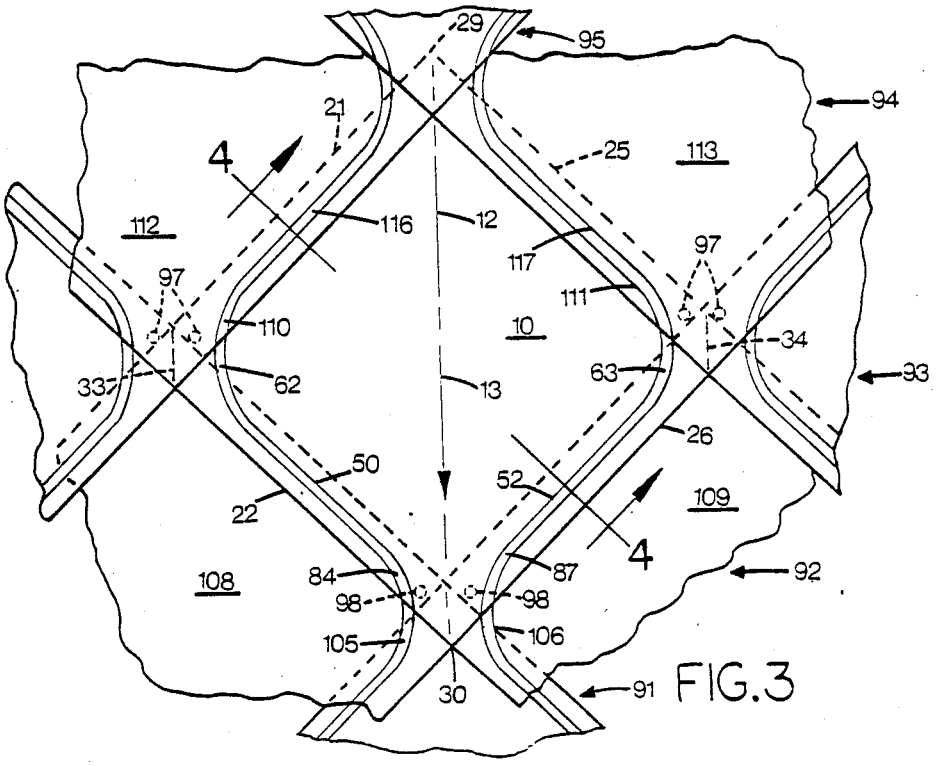
FIG. 3 is a simplified fragmented top plan of a plurality of tiles fitted together showing cooperation between adjacent tiles.
Figure 5:
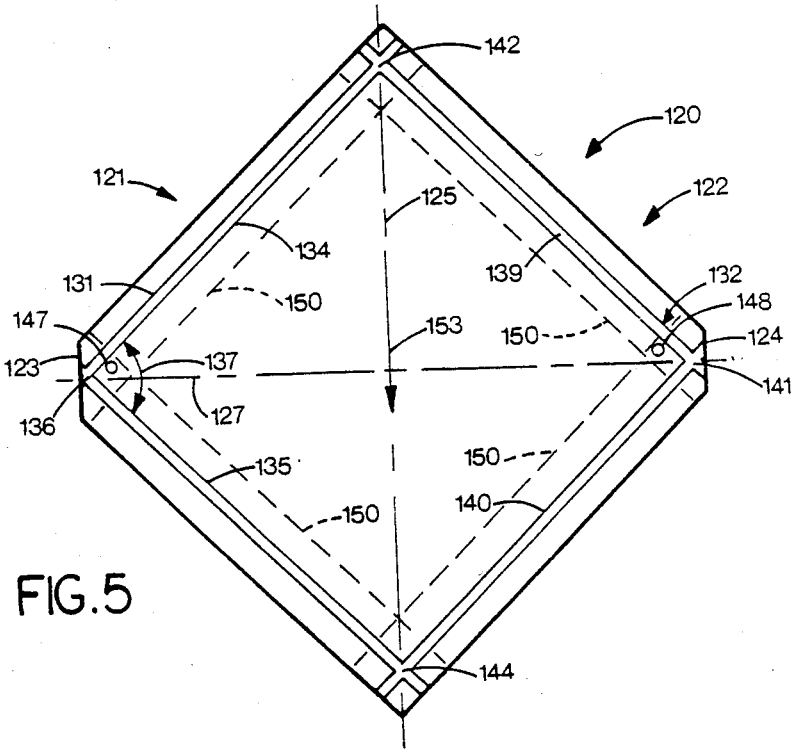
FIG. 5 is a simplified top plan of an alternate tile according to the invention.

A tile 10 is formed from a relatively thin sheet of metallic material and has a periphery disposed symmetrically about a central axis 12. When the tile is installed, the central axis 12 coincides with a line defining free water flow down the tile, shown as an arrow 13, between upper and lower tile portions 14 and 15. The tile has first and second side edges 18 and 19 disposed symmetrically about the axis 12. The side edge 18 has generally straight upper and lower edge portions 21 and 22 respectively, and the side edge 19 has upper and lower edge portions 25 and 26. The edge portions 21 and 25 are inclined at equal angles 28 to a transverse line 30 or lateral axis 27 which is disposed penpendicularly to the central axis of the tile. Similarly, edge portions 22 and 26 are inclined at equal angles 31 to the line 30 27. Preferably, the angles 28 and 31 are equal to 45 degrees, so that the portions 21 and 22, and the portions 25 and 26, are inclined to each other at 90 degrees, ignoring mitred edge portions as will be described. Upper and lower portions of the side edges 18 and 19 intersect each other at upper and lower corners 29 and 30 respectively of the tile, which are at opposite ends of the axis 12 as shown. Angles between adjacent sides 21 and 25, and 22 and 26 are also 90 degrees, so as to define a generally square tile, which, when installed with the central axis 12 vertical defines a generally diamond-shaped tile. As can be seen, a first mitred edge portion 33 interconnects the upper and lower edge portions 21 and 22, and a second mitred edge portion 34 interconnects the upper and lower edge portions 25 and 26. The mitred edge portions 33 and 34 are disposed symmetrically relative to the central axis 13 and the transverse line 30 27 and are necessary to provide clearance for adjacent tiles, as will be described with reference to FIG. 3. First and second nail holes 35 and 36 are positioned adjacent the mitred edge portions 33 and 34, and spaced slightly upwardly from the transverse line 30 27. The holes receive nails, not shown, for securing to a base of the roof, such as battens or plywood sheathing, not shown. The nails and holes serve as attachment means adjacent the first and second side edges and generally adjacent the transverse line to provide an attachment to the roof approximately half way down the tile. This limits the moment arm of the free end or lower portion of the tile for bending about the line 30 27, and also permits the nail to be covered by adjacent upper tiles and will be described.

Broken lines 39 and 40 designate approximate positions of lower edge portions of adjacent tiles fitted over and to the left and right respectively of the tile 10. Similarly, broken lines 41 and 42 represent approximate positions of upper edge portions of adjacent tiles fitted under and to the left and right of the tile 10. This produces generally equal overlaps 43 betwen adjacent tiles which are important to the invention, as will be described with reference to FIG. 3.

The above describes a diamond shape tile of very simple form, which resembles, to some extent, old fashioned relatively thick clay tiles, simple metallic or natural slates tiles. The present invention is distinguished from this basic structure by providing first and second raised ribs 45 and 46 which extend symmetrically as mirror images of each other on each side of the central axis. The first rib 45 has a rib axis 47, and upper and lower rib portions 49 and 50, and the second rib 46 has a rib axis 48, and upper and lower rib portions 51 and 52. The upper and lower rib portions of each rib are interconnected so as to extend continuously between the upper and lower tile portions 14 and 15 to increase stiffness of the tile relatively to a flat plate. As seen in FIG. 2A, the rib 45 has a convex upper rib surface 54 and a concave lower rib surface 55, the rib surfaces being spaced apart by thickness 56 of the rib which approximates to thickness of a centre portion 57 of the tile. Thus the tile has an essential equal thickness throughout and can be made by simply pressing a thin gauge steel, suitably treated for corrosion resistance. The rib 46 is similarly shaped, so that both ribs have upper convex surfaces on the same side as the tile. At positions remote from the upper and lower corners 29 and 30, intermediate lengths of the first and second ribs are spaced inwardly from the adjacent first and second side edges 18 and 19 to define first and second side margins 59 and 60 respectively of the tile. The central portion 57 is generally flat and coplanar with the first and second side margins 59 and 60, as best seen in FIGS. 2A and 2B.

To enable adjacent tiles to cooperate with each other, the upper rib portions 49 and 51 are smaller than, and generally complementary to, the lower rib portions 50 and 52 respectively, so that the lower rib portions of an upper tile can fit over upper rib portions of a lower tile. Thus, it can be seen that the rib axes of the upper and lower rib portions are also mirror images of each other about the lateral axis 27, so that the tile is essentially symmetrical about both the central and lateral axes 12 and 30 respectively. To attain a relatively close fit between upper and lower tiles, it is essential that the rib portions do not interfere prematurely with each other. This permits coplanar flat portions of the tiles on either side of the rib portions to contact each other, as will be described with reference to FIG. 4. While it is not necessary that the engaging upper and lower surfaces of the rib portions and adjacent tile portions are exactly complementary to each other, the lower rib portion should be no greater in height or width than the maximum that can fit closely underneath the upper rib portion. To avoid prior art problems relating to capillarity between closely fitting tiles, that is the ability of water to be drawn upwardly through a narrow gap between adjacent tiles, preferably there should be some reasonable clearance between edges of two tiles. This clearance can be of the order of 0.5 millimetres, or slightly greater than this should prevent excessive problems due to capillarity, and will also permit greater tolerance in manufacturing and fitting of tiles.

In FIG. 2A, the plane of section shown in full outline is taken on the transverse line 30 27, and intersects the first raised rib 45 at an intermediate rib portion 62, which is at a position intermediate of the upper and lower rib portions 49 and 50. The partial section shown in broken outline is taken on the upper rib portion 49, and it can be seen that the upper rib portion is smaller than the intermediate rib portion 62. As drawn, a lower surface 61 of the lower rib portion 49 is spaced from the lower surface 55 of the intermediate rib portion 62 by an amount equal approximately to one half of the thickness 56 of the plate. This is not critical, but for this particular embodiment this is the preferred difference in positions of the lower surface.

The intermediate rib portion 62 is a portion of a curve or arc centred on point 64, which is disposed on the transverse line 30 27. The intermediate portion 62 is defined by an arc 65 positioned between intersections of the first rib 45 with the broken lines 39 and 41 which represents the position of the edges of adjacent tiles. The arc 65 subtends an angle 66 at the point 64, which is typically about 10-20 degrees, although this can vary depending on the overlap of the tile and the shape of the first rib.

The upper rib portion 49 has an essentially constant cross-section from an upper end 69 adjacent the upper edge portion 21 of the tile to a lower connection 70 with the intermediate portion 62. Similarly, the lower rib portion 50 has an essentially constant cross-section from an upper connection 73 with the intermediate portion 62 to a lower end 74 adjacent the lower edge portion 22 of the tile. Thus the rib 45 intersects the side edge 18 at the upper and lower ends 69 and 74 respectively of the ribs. It can be seen that each upper rib portion, as defined above by its constant cross-section, has a generally shallow S-shape with a generally straight mid portion 77 disposed between upwardly and downwardly curved upper and lower terminal portions 78 and 79. The mid portion is generally parallel to the adjacent upper side edge portion 21. Similarly, the lower rib portion 50 has an essentially constant crosssection and a generally shallow S-shape with a generally straight mid portion 82 disposed between upwardly and downwardly curved upper and lower terminal portions 83 and 84. The mid portion 82 is generally parallel to the adjacent lower side edge portion 22.

The second raised rib 46 has an intermediate portion 63 which is generally similar to the portion 62 of the first raised rib, but is a mirror image thereof about the axis 12. As can be seen in FIG. 2B, the lower rib portion 52 has a cross-section shown partially in broken outline that is larger than the cross-section of the intermediate rib portion 63, which is identical in size to the portion 62 of FIG. 2. Each upper rib portion is thus connected smoothly to the respective lower rib portion by a respective intermediate rib portion. The intermediate rib portion has a size which increases from intersections with the upper rib portion to the lower rib portion to provide a continuous transition between the adjacent rib portions so that the lower rib portions of an upper tile can fit over the upper rib portions of a lower tile, and so that the tile has continuous stiffening ribs extending between upper and lower tile portions. In summary, the ribs 45 and 46 intersect the respective side edges 21 and 22 generally adjacent to the upper and lower corners 29 and 30 respectively. This provides first and second intermediate edge portions 80 and 81 extending between the intersections of the first and second ribs 45 and 46 with the first and second side edges 18 and 19 respectively. It can be seen that the first side margin 59 extends between the first intermediate edge portion 80 and the first rib 45, and the second side margin 60 extends between the second intermediate edge portion 81 and the second rib 46.

As can be seen in FIG. 1, upper terminal portions 78 and 86 of the upper rib portions 49 and 51, and lower terminal portions 84 and 87 of the lower rib portions 50 and 52 are spaced apart by spacings 88 and 89 respectively to provide clearance therebetween to permit water to pass easily down the tile. Also, the upper and lower terminal portions of the rib portions curve smoothly upwardly and downwardly respectively to intersect side edges of the tile adjacent the upper and lower tile portions respectively, and curvature of the terminal portions are generally equal to each other, so as to permit complementary overlapping of the rib portions as previously described, and as described in more detail with reference to FIGS. 3 and 4.

OPERATION

FIGS. 3 and 4

The roof which is to be tiled can be fitted with longitudinally extending battens, not shown, or plywood sheathing, depending on conventional building practice. If battens are used, space between adjacent battens corresponds to space between nail holes of adjacent tiles, which is approximately one half of the length of the tile measured along the axis 12. For any roof structure the method of installing the tiles is essentially the same.

Tiles are first laid along the lower portion of the roof, preferably in horizontal lines extending from end to end of the roof. Adjacent horizontal rows of tiles are installed, one upon the other, working progressively up towards the ridge of the roof.

FIG. 3 shows portions of five horizontal rows of tiles, the rows designated 91 through 95 moving progressively up the roof. Mitred portions of adjacent tiles in the same row are closely adjacent each other. Four nails 97, shown in broken outlines, secure some tiles of the row 93, and are in themselves covered by lower portions of side margins of the tiles in the row 94. Similarly nails 98 secure the tiles of the row 92 and are covered by side margin lower portions of the tiles in row 93. Edges of tiles that are not covered by side margins of other tiles are shown in broken outline, and it can be seen that all tile edges are well overlapped to reduce chances of water passing between tiles, either by wind force, water flow or capillarity.

For convenience of explanation, the tile 10 is shown as the central tile in the row 93 and it can be seen that the downwardly curved lower terminal portions 84 and 87 of the lower rib portions 50 and 52 merge smoothly and overlap complementary intermediate rib portions 105 and 106 respectively of two tiles 108 and 109 in the row 92. Similarly, lower terminal portions 110 and 111 of tiles 112 and 113 in the row 94 overlap the intermediate portions 62 and 63 of the tile 10. Water flowing down the roof in direction of the arrow 13 is restricted only slightly by the continuous S-shaped curves of raised ribs which never totally obstruct water flow. It is seen that the lower rib portions 50 and 52 of the tile 10 overlap completely upper rib portions, not shown in FIG. 3, of the tiles 108 and 109. Similarly, lower rib portion 116 and 117 of the tiles 112 and 113 overlap completely upper rib portions 49 and 51, not shown in FIG. 3, of tile 10.

The overlapping between the lower rib portions of the upper tile and upper rib portions of a lower tile are more clearly seen in FIG. 4 which shows cooperation between the tiles 112, 10 and 109. The rib portion 116 is shown overlapping the rib portion 49, and the rib portion 52 of the tile 10 is shown overlapping upper rib portion 118 of the tile 109. The overlapping rib portions are shown to be exactly complementary, but this is not desirable or practical for tiles manufactured and installed to normal tolerances.

ALTERNATIVES AND EQUIVALENTS

The tile 10 is shown as a square tile, with two oppositely mitred corners. Thus, angles between the four main edges of the tile are 90 degrees, and in general edges of the tile are equal in length. While this provides a conventional and pleasing tile appearance, variations of the overall shape of the tile are possible, provided the opposite side edges are disposed as mirror images about the axis 12.

Also, in FIGS. 2A, 2B and 4, it can be seen that the rib portions of each tile are generally complementary to each other, that is the ribs are a portion of an arc which merges smoothly with large radii to adjacent flat portions of the centre portion of the tile, and coplanar margins of the tile. Clearly, upper portions of the lower tile which are overlapped by an upper tile could be of a different shape, and considerably smaller than under surfaces of the corresponding upper tile. This would permit a greater tolerance to installing the tiles, and, in some cases, reduces chances of water being drawn by capillarity across the rib portions. The ridges could be different cross-sections, i.e. triangular, trapezoidal etc.

Also, as defined, the upper rib portion has the smallest constant cross-section, the lower rib portion has the largest constant cross-section, and the intermediate portion has a variable cross-section which changes smoothly from the smallest cross-section to the largest cross-section over a short arc 65 to provide the transition in sizes of ribs. In an alternative raised rib, the cross-section could vary essentially continuously from the smallest adjacent the upper side edge (e.g. equivalent to the rib end 69 at the edge 21) to the largest adjacent the lower side edge (e.g. equivalent to the rib end 74 adjacent the edge 22). This would eliminate the short intermediate rib portion (e.g. 62,63) because the whole length of the raised rib would have a gradually changing cross-section which would still be generally complementary to adjacent ribs to provide cooperation as previously described. In yet another alternative, portions of the upper rib portion could be of one constant cross section, portions of the lower rib portion would be of a larger constant cross sections and the intermediate portions could extend over a larger arc than shown to interconnect the upper and lower portions. Many variations are possible, within the broad concept of the upper rib portions being smaller than and complementary to the lower rib portions.

While the preferred material of manufacture is corrosion resistant steel of about 26 gauge (i.e. 0.5 mm), suitably rinforced plastic could be substituted.

FIG. 5

An alternative tile 120 has first and second side edges 121 and 122 which define a generally square shaped tile with mitred edge portions 123 and 124 respectively. The tile has a central axis 125 which intersects at right angles a transverse line 127 which lines passes through mid portions of the mitred edge portions 123 and 124, similarly to the tile 10 of FIGS. 1 through 4.

A main difference between the tile 120 and the tile 10 relates to the raised ribs. The tile 120 has first and second raised ribs 131 and 132 respectively which are disposed as mirror images about the axis 125. The rib 131 has a straight upper rib portion 134, and a similar straight lower rib portion 135, the rib portions intersecting at a first intersection 136 at an angle 137, in this instance 90 degrees, adjacent the mitred edge portion 123. Similarly, the second raised rib 132 has a straight upper rib portion 139 and a straight lower rib portion 140 similarly intersecting at a second intersection 141 adjacent the line 127. Thus each upper rib portion on one side of the central axis intersects the lower rib portion on the same side of the axis so that upper and lower rib portions extend continuously between upper and lower tile portions to stiffen the tile. Each upper rib portion is generally straight and parallel to an adjacent upper side edge portion, the upper rib portions intersecting each other at an intersection 142 adjacent an upper tile portion at the central axis. Similarly, each lower rib portion is generally straight and parallel to an adjacent lower side edge portion, the lower rib portions intersecting each other at a lower intersection 144 adjacent a lower tile portion at the central axis. Each upper rib portion has an essentially constant cross-section along the length thereof, and similarly each lower rib portion has an essentially constant cross-section along the length thereof. Clearly, the upper rib portions are smaller than, and generally complementary to, the lower rib portions so that the lower rib portions of an upper tile can fit over upper rib portions of a lower tile, similarly to the previously described tile 10. First and second nail holes 147 and 148 are adjacent the first and second intersections 136 and 141, and are sufficiently close to the adjacent intersection so as to be covered by an overlapping edge of adjacent tiles, shown as several broken lines 150. Thus, similarly to the tile 10, nails of this tile are covered by overlapping tiles, and preferably are positioned slightly above the transverse line 127.

Arrow 153 defines water flow down the tile between the upper and lower tile portions, and coincides with the axis 125, similarly to the previous embodiment. However, in contrast with the previous embodiment wherein there is negligible restriction of water flow past the end of the tile, with this alternative the lower intersection 144 acts as a type of dam, which restricts water flow off the tile. This is a possible disadvantage that should be considered when installing this type of tile. Clearly, in areas of low precipitation this restriction is not a problem. This contrasts with the smooth open connection between the lower rib portions 50 and 52 of the tile 10, and intermediate the rib portions 105 and 106 of the tiles 108 and 109, wherein the clearances 89, FIG. 1, between raised rib portions adjacent the lower portion restrict minimally flow of water down the tile indirection of the arrow 13 as the water passes from the tile 10 onto tiles in the row 91.

With the tile 120 the intersections 142 and 144 produce visual discontinuities when looking up at the roof, which constrasts with the smooth connections between adjacent rib portions of the tile 10 which provide a pleasing aesthetic appearance of continuous raised ribs extending in graceful curves down the roof.

I claim:

1. A tile adapted to cooperate with similar tiles to form a tiled surface, the tile being a relatively thin sheet and having:

(a) a periphery having first and second side edges intersecting at upper and lower corners and being disposed symmetrically about a central axis extending between the corners so that, when the tile is installed, the central axis coincides essentially with a line defining free water flow down the tile between upper and lower tile portions, the side edges being mirror images of each other about the central axis, (b) first and second raised ribs extending symmetrically as mirror images of each other on each side of central axis, each rib having upper and lower rib portions which are substantially similar in cross-section to each other and are interconnected so as to extend smoothly and continuously between the upper and lower tile portions to increase stiffness of the tile, the upper and lower rib portions having rib axes which are also mirror images of each other about a lateral axis disposed normally to the central axis, the ribs intersecting the respective side edges generally adjacent to the upper and lower corners to provide first and second intermediate edge portions extending between the intersections of the first and second ribs with the first and second side edges respectively, (c) a generally flat first side margin of the tile extending between the first intermediate edge portion and the first rib, and a generally flat second side margin of the tile extending between the second intermediate edge portion and the second rib, (d) the upper rib portions being generally complementary to the lower rib portions so that the lower rib portions of an upper tile can fit over the upper rib portions of a lower tile.

2. A tile as claimed in claim 1 further characterized in that:

(a) the upper rib portion of each rib has a convex upper rib surface, (b) the lower rib portion of each rib has a concave lower rib surface which is generally complementary to the convex upper rib surface, so as to permit the lower rib portion of the upper tile to fit closely over the upper rib portion of the lower tile.

3. A tile as claimed in claim 1 further characterized in that:

(a) each rib has a convex upper rib surface and a concave lower rib surface, the rib surfaces being spaced apart by thickness of the rib which approximates to thickness of a centre portion of the tile.

4. A tile as claimed in claim 1 further characterized in that:

(a) the tile has a generally flat central portion which is generally coplanar with the first and second side margins of the tile.

5. A tile as claimed in claim 1 further characterized in that:

(a) each side edge has generally straight upper side edge and lower side edge portions which are inclined at equal angles to the lateral axes disposed perpendicularly to the central axis of the tile to define a generally diamond shaped tile.

6. A tile as claimed in claim 1 further characterized in that:

(a) each upper rib portion is connected smoothly to the respective lower rib portion by a respective intermediate rib portion, the intermediate rib portion having a size which increases from the upper rib portion to the lower rib portion to provide a transition between the rib portions so that the lower rib portions of an upper tile can fit over the upper rib portions of a lower tile.

7. A tile as claimed in claim 1 further characterized in that:

(a) the tile has first and second side edges, each side edge having generally straight upper side edge and lower side edge portions which are inclined at equal angles to a transverse line disposed perpendicularly to the central axis of the tile to define a generally diamond shaped tile, (b) each upper rib portion has a generally shallow S-shape with a generally straight mid portion disposed between upwardly and downwardly curved upper and lower terminal portions, the mid portion being generally parallel to an adjacent upper side edge portion, (c) each lower rib portion has a generally shallow S-shape with a generally straight mid portion disposed between upwardly and downwardly curved upper and lower terminal portions, the mid portion being generally parallel to an adjacent lower side edge portion.

8. A tile as claimed in claim 6 further characterized in that:

(a) each upper rib portion has an essentially constant cross-section froman upper end adjacent the upper edge portion of the tile to a lower connection with the intermediate portion, (b) each lower rib portion has an essentially constant cross-section from an upper connection with the intermediate portion to a lower end adjacent the lower edge portion of the tile.

9. A tile as claimed in claim 1 further characterized by:

(a) the upper and lower rib portions have upper and lower terminal portions respectively which are spaced apart to provide clearance therebetween to permit water to pass easily down the tile.

10. A tile as claimed in claim 9 further characterized in that:

(a) the upper and lower terminal portions of the rib portions curve smoothly upwardly and downwardly respectively to intersect side edges of the tile adjacent the upper and lower tile portions respectively.

11. A tile as claimed in claim 5 further characterized in that:

(a) a first mitred edge portion interconnects the upper and lower edge portions of the first side edge, (b) a second mitred edge portion interconnects the upper and lower edge portions of the second side edge, the first and second mitred edge portions being disposed symmetrically relative to the central axis and lateral axis.

12. A tile as claimed in claim 5 further characterized in that:

(a) attachment means are provided adjacent the first and second side edges, so as to be generally adjacent the lateral axis.

13. A tile as claimed in claim 11 further characterized in that:

(a) attachment means are provided adjacent each mitred edge portion, and generally adjacent the lateral axis.

14. A tile as claimed in claim 5 further characterized in that:

(a) a first mitred edge portion interconnects the upper and lower edge portions of the first side edge, (b) a second mitred edge portion interconnects the upper and lower edge portions of the second side edge, the first and second mitred edge portions being disposed symmetrically relative to each other, (c) the mitred edge portions are disposed at opposite ends of the lateral axis, 15. A tile as claimed in claim 1 further characterized in that:

(a) the tile has first and second side edges, each side edge having generally straight upper side edge and lower side edge portions which are inclined at equal angles to a transverse line disposed perpendicularly to the central axis of the tile to define a generally diamond shaped tile, (b) each upper rib portion is generally straight and parallel to an adjacent upper side edge portion, the upper rib portions intersecting each other adjacent the upper tile portion at the central axis, (c) each lower rib portion is generally straight and parallel to an adjacent lower side edge portion, the lower rib portions intersecting each other adjacent the lower tile portion at the central axis, (d) each upper rib portion on one side of the central axis intersects the lower rib portion on that same side of the axis, so that the upper and lower rib portions extend continuously between the upper and lower tile portions to stiffen the tile.

16. A tile as claimed in claim 15 further characterized in that:

(a) each upper rib portion has an essentially constant cross-section along the length thereof, (b) each lower rib portion has an essentially constant cross-section along the length thereof.

17. A tile adapted to cooperate with similar tiles to form a tiled surface, the tile being a relatively thin sheet and having:

(a) a periphery having first and second side edges intersecting at upper and lower corners and being disposed symmetrically about a central axis extending between the corners so that, when the tile is installed, the central axis coincides essentially with a line defining free water flow down the tile between upper and lower tile portions, (b) first and second raised ribs extending symmetrically as mirror images of each other on each side of the central axis, each rib having upper and lower rib portions which are interconnected so as to extend continuously between the upper and lower tile portions to increase stiffness of the tile, the upper and lower rib portions having rib axes which are also mirror images of each other about a lateral axis disposed normally to the central axis, (c) intermediate lengths of the first and second ribs remote from the upper and lower corners being spaced inwardly from the adjacent first and second side edges of the tile to provide generally flat first and second side margins of the tile, (d) the upper rib portions being generally complementary to the lower rib portions so that the lower rib portions of an upper tile can fit over the upper rib portions of a lower tile, (e) each side edge has generally straight upper side edge and lower side edge portions which are inclined at equal angles to the lateral axis disposed perpendicularly to the central axis of the tile to define a generally diamond shaped tile, (f) each upper rib portion has a generally shallow S-shape with a generally straight mid portion disposed between upwardly and downwardly curved upper and lower terminal portions, the mid portion being generally parallel to an adjacent upper side edge portion, (g) each lower rib portion has a generally shallow S-shape with a generally straight mid portion disposed between upwardly and downwardly curved upper and lower terminal portions, the mid portion being generally parallel to an adjaceant lower side edge portion.

18. A tile as claimed in claim 17 in which:

(a) each rib has a convex upper rib surface and a concave lower rib surface, the rib surfaces being spaced apart by thickness of the rib which approximates to thickness of a centre portion of the tile.

19. A tile as claimed in claim 17 in which:

(a) the tile has a generally flat central portion which is generally coplanar with the first and second side margins of the tile.

20. A tile as claimed in claim 17 in which:

(a) the upper and lower rib portions have upper and lower terminal portions respectively which are spaced apart to provide clearance therebetween to permit water to pass easily down the tile.

21. A tile as claimed in claim 20 in which:

(a) the upper and lower terminal portions of the rib portions curve smoothly upwardly and downwardly respectively to intersect side edges of the tile adjacent the upper and lower tile portions respectively.

22. A tile as claimed in claim 17 in which:

(a) a first mitred edge portion interconnects the upper and lower edge portions of the first side edge, (b) a second mitred edge portion interconnects the upper and lower edge portions of the second side edge, the first and second mitred edge portions being disposed symmetrically relative to the central axis and the lateral axis.

23. A tile as claimed in claim 17 in which:

(a) attachment means are provided adjacent the first and second side edges, so as to be generally adjacent the lateral axis.

* * * * *